US007282312B2

(12) United States Patent
Jung et al.

(10) Patent No.: US 7,282,312 B2
(45) Date of Patent: Oct. 16, 2007

(54) TONER HAVING BI-LAYER OR TRIPLE-LAYER

(75) Inventors: Woo-cheul Jung, Ulsan (KR); Woong-ki Lee, Daejeon (KR); Tae-hee Yoon, Daejeon (KR)

(73) Assignee: LG Chem, Ltd., Seoul (KR)

( * ) Notice: Subject to any disclaimer, the term of this patent is extended or adjusted under 35 U.S.C. 154(b) by 215 days.

(21) Appl. No.: 10/520,676

(22) PCT Filed: Apr. 8, 2004

(86) PCT No.: PCT/KR2004/000813

§ 371 (c)(1),
(2), (4) Date: Jan. 11, 2005

(87) PCT Pub. No.: WO2004/090644

PCT Pub. Date: Oct. 21, 2004

(65) Prior Publication Data

US 2005/0255400 A1 Nov. 17, 2005

(30) Foreign Application Priority Data

Apr. 8, 2003 (KR) ..... 10-2003-0021801
Apr. 7, 2004 (KR) ..... 10-2004-0023749

(51) Int. Cl.
*G03G 9/08* (2006.01)

(52) U.S. Cl. ..... 430/110.2; 430/137.15

(58) Field of Classification Search ..... 430/110.2, 430/109.3, 137.12, 137.15, 137.17
See application file for complete search history.

(56) References Cited

U.S. PATENT DOCUMENTS

| | | | | |
|---|---|---|---|---|
| 5,536,612 | A * | 7/1996 | Yamaguchi et al. | ... 430/137.12 |
| 5,976,755 | A | 11/1999 | Yoshida et al. | |
| 6,177,223 | B1 | 1/2001 | Hashimoto et al. | |
| 6,337,169 | B1 | 1/2002 | Hashimoto et al. | |

FOREIGN PATENT DOCUMENTS

| | | | |
|---|---|---|---|
| EP | 0615167 | A1 | 9/1994 |
| EP | 0743564 | A2 | 11/1996 |
| EP | 0952495 | A1 | 10/1999 |
| JP | 7-128908 | | 5/1995 |

* cited by examiner

*Primary Examiner*—Hoa Van Le
(74) *Attorney, Agent, or Firm*—McKenna Long & Aldridge LLP

(57) ABSTRACT

The present invention relates to a toner having a double- or triple-layered structure. The present invention is effective in that pigments and charge control agents are located most properly for the realization of high-resolution toners through addition and polymerization of hydrophilic monomers or polymers with the toners; the manufacture of high-resolution toners becomes very easy irrespective to the kind and amount of a wax used for polymerized toners by forming thin layers by using polar grafting agents; and long-term preservation is assured as well as the affect by moisture is minimized.

15 Claims, 3 Drawing Sheets

1 : Example 4, 2 : Example 2 and Comparative Example 2

3 : Example 3, 4 : Example 1 and Comparative Example 1

(a)

Examples 2 and 4

(b)

Example 3

(c)

Comparative Examples 3~5

TONER HAVING BI-LAYER OR TRIPLE-LAYER

TECHNICAL FIELD

The present invention relates to a toner having a double- or triple-layered structure with a superior weatherability. In more detail, the present invention relates to weatherproof toners having a double- or triple-layered structure in which pigments and charge control agents are located most properly for the realization of high-resolution toners through addition and polymerization of hydrophilic monomers or polymers with the toners; the manufacture of high-resolution toners becomes very easy irrespective to the kind and amount of a wax used for polymerized toners by forming thin layers by using polar grafting agents; and long-term preservation is assured as well as the affect by moisture is minimized.

BACKGROUND ART

Generally, toners are used for the development of electronic photographs, electrostatic printers, copying machines, etc. and refer to pigments used for the development of pictorial images in printed materials during the printing work. It has been the actual situation that the demand for image-formation devices such as printers, etc. has been increased rapidly, and consequently, the amount of use of toners has been increased as the preparation for documents using computers and similar works has been generalized recently.

There are many methods of manufacturing toners. In the melting-mixing process, which is the most widely known general method, resins and pigments are put together, melted and mixed or extruded, and pulverized and classified in order to manufacture toner particles. However, the toner particles manufactured according to the above process have been problematic in their charging or flowing property since they have a wide distribution of particle sizes and very irregular shapes such as sharp edges, etc.

In order to resolve the above problem, methods of manufacturing spherical toner particles according to the polymerization method have been presented. As concrete methods by the above polymerization method, emulsion polymerization method and suspension polymerization method have been known. At present, the suspension polymerization is preferred since the emulsion polymerization is more complicated process.

The method of manufacturing toners by the suspension polymerization is disclosed in the U.S. Pat. No. 6,337,169. What is claimed in this patent is that the pigment included in a wax forms pictorial images promptly with the wax since the wax is melted promptly when the toner is fused at a high temperature if only the fixed part of a pigment is melted in the wax, thus enabling the formation of high-quality pictorial images. The structure of the wax at that time is in one or a few large spherical shapes in the central binder portion, and is in the sea-island-sea shape on the whole. However, in order for the wax to have such structure, the type of the wax used for the binder has to be limited. Further, there have been problems that the fixed part of the pigment in the toner has been melted in the wax, and the remainder has been dispersed in the binder, or all of the pigments are dispersed evenly in the binder; and the charge control agent, assuming the most important role in the charging characteristics of toners, has failed to have been located at the outer side efficiently as well. Still further, there has remained the problem of excessive absorption of moisture according to the increased amount of charging although the amount of an electric charge on the surface of toners is increased.

In other words, in order to form high-quality pictorial images, the development of toner particles, capable of increasing the surface concentration of the charge control agent in the toners irrespective to the type of the wax and stopping the subsequent absorption of moisture, has been demanded continuously.

DISCLOSURE OF THE INVENTION

The present invention is provided with in order to more efficiently resolve the problems of the prior art as described above.

The objects of the present invention are, therefore, to implement a high charging effect and a high image density (I.D.) by manufacturing a core through suspension polymerization of binder resin monomers, molecular weight controlling agents, pigments, charge control agents, dispersion agents, anionic surfactants, waxes, polar grafting agents and hydrophilic monomers, and thus locating the charge control agents and pigments toward the surface; and to provide with highly weatherproof toners characterized by having a double-layered structure by being manufactured with the further formation of a shell in the hard portion on the core in order to solve problems of long-term preservation and absorption of moisture coming from the use of hydrophilic monomers.

Another object of the present invention is for hydrophilic polymers to have a double-layered structure in which the outer side of toners is surrounded by the hydrophilic polymers as binder resin monomers, molecular weight controlling agents, pigments, charge control agents, dispersion agents, anionic surfactants, waxes, polar grating agents, and hydrophilic polymers are manufactured through suspension polymerization. Here, the toners have a high charging effect and image density as the pigments and charge control agents are concentrated on the hydrophilic polymer layers forming double layers. Further, in order to solve the problems of long-term preservation and absorption of moisture, highly weatherproof toners characterized by having a triple-layered structure by further forming a shell in the hard portion are provided with in the present invention.

The present invention further provides with high-resolution and superior toners having a single-layered structure by being manufactured through suspension polymerization of binder resin monomers, molecular weight controlling agents, pigments, charge control agents, dispersion agents, anionic surfactants, waxes, polar grafting agents, and hydrophilic monomers.

Also, the present invention provides with high-resolution and superior toners having a double-layered structure by being manufactured through suspension polymerization of binder resin monomers, molecular weight controlling agents, pigments, charge control agents, dispersion agents, anionic surfactants, waxes, polar grafting agents, and hydrophilic monomers.

Still further, the present invention provides with high-resolution and highly weatherproof toners having a double-layered structure by forming a single-layered structure through suspension polymerization of binder resin monomers, molecular weight controlling agents, pigments, charge control agents, dispersion agents, anionic surfactants, waxes, polar grafting agents, and hydrophilic monomers and manufacturing a shell which is a rigid layer by inputting styrene monomers and cross-linking agent on top of the single-layered structure.

Still yet further, the present invention provides with high-resolution and highly weatherproof toners having a triple-layered structure by forming a double-layered structure through suspension polymerization of binder resin monomers, molecular weight controlling agents, pigments, charge control agents, dispersion agents, anionic surfactants, waxes, polar grafting agents, and hydrophilic polymers and manufacturing a shell which is a rigid layer by inputting styrene monomers and cross-linking agent on top of the single-layered structure.

The above-described hydrophilic monomer is one or more kinds of compounds selected from the group consisting of acrylic acid, methyl methacrylate, and acetate, and its content may be 0.1 to 20 parts by weight with respect to the total weight of the monomer mixture.

The above-described hydrophilic polymer is one or more kinds of polar polymers selected from the group consisting of polyester-group and styrene acrylic polymers, and its content may be 0.1 to 20 parts by weight with respect to the total weight of the monomer mixture.

The above-described polar grafting agent is one or more kinds of compounds selected from the group consisting of ethylene dimethacrylate, ethylene glycol dimethacrylate, diethylene glycol diacrylate, 1,6-hexamethylene diacrylate, allyl methacrylate, 1,1,1-trimethylol propane triacrylate, and triallyl amine, and its content may be 0.001 to 10 parts by weight with respect to the total weight of the monomer mixture.

The above-described binder resin monomer is one or more kinds of monomers selected from the group consisting of aromatic-vinyl-group, acrylate-group, methacrylate-group, diene-group, acidic-olefin-group, and basic-olefin-group monomers, and its content may be 0.1 to 20 parts by weight with respect to the total weight of the monomer mixture.

The above-described pigment is one or more kinds of inorganic pigments selected from the group consisting of metallic-powder-type, metal-oxide-type, carbon-type, sulfide-type, chromate-type, and ferrocyanide-type pigments; or one or more kinds of organic pigments selected from the group consisting of azo-type, acidic-pigment-type, basic-pigment-type, mordant-pigment-type, phthalocyanine, quinacridone-type, and dioxane-type pigments, and its content may be 1 to 100 parts by weight with respect to the total weight of the monomer mixture.

The above-described charge control agent is one or more kinds of cationic charge control agents selected from the group consisting of nigrosine-type electron acceptor pigments, highly aliphatic metallic salts, alkoxy amines, chelates, quarternary ammonium salts, alkyl amides, fluorinated activating agents, and naphthalic acid metallic salts; or one or more kinds of anionic charge control agents selected from the group consisting of electron acceptor organic complexes, chlorinated paraffins, chlorinated polyesters, polyesters containing an excessive amount of acids, styrene-acrylic polymers containing the sulfonyl amine of copper phthalocyanine and sulfonic acid radical, and its content may be 0.01 to 20 parts by weight with respect to the total weight of the monomer mixture.

The above-described dispersion agent is one or more kinds of inorganic dispersion agents selected from the group consisting of calcium phosphate, magnesium salts, hydrophilic silica, hydrophobic silica, and colloidal silica; or one or more kinds of water-soluble organic polymer dispersion agents selected from the group consisting of one or more kinds of non-ionic polymer dispersion agents selected from the group consisting of poly(oxyethylene) alkyl ethers, poly(oxyalkylene) alkyl phenol ethers, sorbitan fatty acid esters, poly(oxyalkylene) fatty acid esters, glycerine fatty acid esters, poly(vinyl alcohols), alkyl cellulose, and poly (vinyl pyrrolidone), and one or more kinds of ionic polymer dispersion agents selected from the group consisting of poly(acryl amides), poly(vinyl amine), poly(vinyl amine) N-oxide, polyvinyl ammonium salts, polydialkyl diallyl ammonium salts, polyacrylic acid, polystyrene sulfonic acid, polyacrylic acid salts, polystyrene sulfonic acid salts, and polyaminoalkyl acrylic acid salts, and its content may be 0.01 to 10 parts by weight with respect to the total weight of the monomer mixture.

The above-described anionic surfactant is one or more kinds of compounds selected from the group consisting of fatty acid salts, alkyl sulfuric acid ester salts, alkyl allyl sulfuric acid ester salts, dialkyl sulfosuccinates, and alkyl phosphates, and its content may be 0.001 to 20 parts by weight with respect to the total weight of the aqueous solution.

The above-described wax is one or more kinds of petroleum refined waxes selected from the group consisting of paraffin waxes, microcrystalline waxes, and ceresin waxes, or natural waxes that are carnauba waxes, or one or more kinds of synthetic waxes selected from the group consisting of polyethylene and polypropylene, and its content may be 0.01 to 30 parts by weight with respect to the total weight of the monomer mixture.

The above-described molecular weight controlling agent is one or more kinds of mercaptane-group compounds selected from the group consisting of t-dodecyl mercaptane and n-dodecyl mercaptane, and its content may be 0.1 to 8 parts by weight with respect to the total weight of the monomer mixture.

Hereinafter, the present invention is illustrated in more detail as follows:

In order to obtain high-quality pictorial images, when printing by locating more than the fixed amount of a pigment on the surface of a binder, it is more efficient for obtaining a vivid-colored quality to have the pigment come out through the shortest route rather than to have the pigment melted in the wax located inside of the resin and come out to the surface through the long route of the resin.

The difference in vividness may be appreciated with naked eyes even in the color of toner particles in the reactor during polymerization. Also, by locating the charge control agents as well as the pigments at the outer side of toner particles, it is possible to increase efficiently the amount of a charge density known experimentally in the past even with a small amount of the charge control agent. Such high charge density assumes a very important role in the formation of a high pictorial quality when printing. Moreover, it is possible to maximize the long-term preservation and resistance to moisture of toners by forming thin layers onto them, where the thickness of thin layers is less than 3 μm.

In the present invention, in order to have the pigments and charge control agents located on the surface of toners, besides styrene-acrylate-group monomers used for typical polymerized toners, hydrophilic auxiliary polymers (such as polymethyl methacrylate, polyesters, etc.) or hydrophilic monomers (such as acrylic acid, acrylate-group monomers, etc.) are used. In other words, during core polymerization using suspension polymerization, by having the hydrophilic portion located at the outer side of the styrene-acrylate binder resin of toners by adding a fixed amount of hydrophilic monomers or hydrophilic polymers, a large amount of the pigment and charge control agent is located on the surface of toners through the interaction among the hydrophilic portion, pigment, and charge control agent. However, the greatest problem with the introduction of such hydrophilic portion is that a clotting phenomenon occurs as the toner absorbs moisture due to the affinity to water, and eventually, the toner may not be used when printing, if more than the fixed amount of the hydrophilic portion is inputted. Accordingly, in the present invention, in order to prevent the clotting phenomenon of toners and to improve long-term preservation, grafting agents are introduced newly and included in monomers, and their thin layers within a range not harming the color and charge density are coated on the surface of the core when printing. After the core polymerization where the thin layers are coated, a shell is formed in the hard portion by inputting monomers again, where the formation of the shell becomes more efficient by using grafting agents, as a result of which the toners that are not sensitive to moisture but can meet a high charge density and a vivid color simultaneously may be polymerized. If the shell is made by inputting lipophilic monomers or polymers without using grafting agents, thin layers are not formed readily as the monomers are diffused rapidly into the core, and the monomers inputted later form their own new areas within the core.

The toners provided with according to the present invention have a core-shell structure, and manufactured according to the suspension polymerization method.

(1) Step of Manufacturing the Core of a Toner

In the manufacture of the core of a toner, firstly, 0.01 to 10 parts by weight of a hydrophilic dispersion agent and 0.01 to 10 parts by weight of a surfactant with respect to the weight of an aqueous solution are prepared for. Secondly, a monomer complex including 0.1 to 20 parts by weight of binder resin monomers including 30 to 90 parts by weight of aromatic vinyl-group monomers with respect to the total weight of the monomer mixture, 5 to 70 parts by weight of one or more kinds of monomers selected from the group consisting of acrylate-group monomers, methacrylate-group monomers, and diene-group monomers with respect to the total weight of the monomer mixture, and 0.1 to 20 parts by weight of an acidic or basic olefin-group monomer with respect to the total weight of the monomer mixture; 0.1 to 20 parts by weight of a hydrophilic monomer or a hydrophilic polymer with respect to the total weight of the monomer mixture; 0.1 to 8 parts by weight of a molecular weight controlling agent with respect to the total weight of the monomer mixture; 1 to 20 parts by weight of a colored pigment with respect to the total weight of the monomer mixture; 0.01 to 30 parts by weight of a wax with respect to the total weight of the monomer mixture; 0.001 to 10 parts by weight of a polar grafting agent with respect to the total weight of the monomer mixture; 0.01 to 20 parts by weight of a charge control agent with respect to the total weight of the monomer mixture; and 0.01 to 5 parts by weight of a polymerization initiator with respect to the total weight of the monomer mixture is prepared for. Then the monomer complex and the mixture which is prepared for by having 1 to 60 parts by weight of the hydrophilic dispersion agent are suspension-polymerized while adding the shearing force.

(2) Step of Formation of the Shell of a Toner

A shell is formed by inputting 1 to 30 parts by weight of a styrene-group monomer and 0 to 5 parts by weight of a cross-linking agent to the core manufactured in the above step (1) in order to manufacture a core-shell-structured toner.

(3) Post-Processing Step

The final toner particles are obtained by removing the dispersion agent from the solution containing the core-shell-structured toner manufactured in the above step (2) in a proper method, separating the toner by repeating the washing process and filtering process, and drying it at a room temperature for 48 hours by using a vacuum oven. The amount of the pigment and degree of the charge density may be controlled according to the amounts and types of hydrophilic monomers and polymers inputted.

In the above, for monomers, one or more kinds of monomers selected from the group consisting of aromatic vinyl-group and acrylate-group, methacrylate-group, and diene-group monomers are used, and selectively, acidic or basic olefin-group monomers may be used.

The above-described aromatic vinyl-group monomers include styrene, monochlorostyrene, methylstyrene, dimethylstyrene, etc., that can be used singly or mixed with one or more kinds of such compounds. It is preferable to use 30 to 90 parts by weight of an aromatic vinyl-group monomer with respect to the total weight of the monomer mixture. The reason for limiting the content of an aromatic vinyl-group monomer to 30 to 90 parts by weight is to adjust Tg of the polymerized toner. Generally, if less than 30 parts by weight of the aromatic vinyl-group monomer is used, Tg of the toner is too low, the toner is attached to the fusing roller during printing, and therefore, problems such as hot offset, etc. may occur; and if greater than 90 parts by weight of such monomer is used, Tg of the toner becomes too high, the toner is not melted sufficiently during printing, and therefore, the problem of greatly lowering settling on sheets of paper may occur.

The above-described acrylate-group monomers include methyl acrylate, ethyl acrylate, n-butyl acrylate, isobutyl acrylate, dodecyl acrylate, 2-ethylhexyl acrylate, etc.; methacrylate-group monomers include methyl methacrylate, ethyl methacrylate, n-butyl methacrylate, isobutyl methacrylate, dodecyl methacrylate, 2-ethylhexyl methacrylate, etc.; and diene-group monomers include butadiene, isoprene, etc., which may be used singly or mixed with one or more kinds of such compounds. It is preferable to use 5 to 70 parts by weight of the above monomer with respect to the total weight of the monomer mixture. As mentioned in the above, the reason for limiting the weight of the monomer to 5 to 70 parts by weight is to prevent the problems that may occur during printing by adjusting Tg of the toner to a proper level.

The above-described acidic olefin-group monomers include α- or β-ethylene compounds having carboxylic radicals, etc.; and basic olefin-group monomers include methacrylic acid esters, methacryl amides, vinyl amine, and diallyl amines of aliphatic alcohols, their ammonium salts, etc. having amine radicals or quarternary ammonium radicals, which may be used singly or mixed with one or more kinds of such compounds. It is preferable to use 0.1 to 20 parts by weight of the above-described acidic olefin-group monomer or basic olefin-group monomer with respect to the total weight of the monomer mixture. The acidic or basic olefin-group monomer is added in order to improve the charging characteristic of the surface. However, if its content exceeds 20 parts by weight, it has a negative affect on the reaction stability during the polymerization of the toner and a large amount of coagulum is generated after polymerization.

The above-described hydrophilic monomers include acrylic acid, methyl methacrylate, acetate, etc., which may be used singly or mixed with one or more kinds of such compounds. It is preferable to use 0.1 to 20 parts by weight of the above hydrophilic monomer with respect to the total weight of the monomer mixture. If its content is less than 0.1 part by weight, the desired effect, i.e., effective positioning of the charge control agents and pigments on the surface of the toner is failed; if it exceeds 20 parts by weight, the reaction stability is lowered in suspension polymerization which is reacted in water.

The above-described hydrophilic polymers include polyesters, styrene acryls, etc., which may be used singly or mixed with one or more kinds of such compounds. It is preferable to use 0.1 to 20 parts by weight of the above hydrophilic polymer with respect to the total weight of the monomer mixture. If the content of the hydrophilic polymer is less than 0.1 parts by weight, it is not possible for the hydrophilic polymer to form the polymer layer on the surface of the toner efficiently; if it exceeds 20 parts by weight, the reaction stability is disturbed as the phase separation occurs during polymerization.

It is possible to use oily initiators and aqueous initiators for the above-described polymerization initiators. Their concrete examples include azo-group initiators such as bis-isobutyronitrile, azobisdimethyl valeronitrile, etc.; organic peroxides such as benzoyl peroxide, lauroyl peroxide, etc.; and usual aqueous initiators such as potassium persulfate, ammonium persulfate, etc. It is preferable to use 0.01 to 5 parts by weight of a polymerization initiator with respect to the total weight of the monomer mixture. If its content is less than 0.01 parts by weight, there remain unreacted materials; if it exceeds 5 parts by weight, the reaction speed is too fast and the reaction stability is lowered.

Mercaptane-group compounds such as dodecyl mercaptane, n-dodecyl mercaptane, etc. may be used for the above-described molecular weight controlling agents, which may be used singly or mixed with one or more kinds of such compounds. It is preferable to use 0.1 to 8 parts by weight of the above-described molecular weight controlling agent with respect to the total weight of the monomer mixture. A molecular weight controlling agent is added in order to further improve settling of the toner during printing by lowering the molecular weight, but may not be added, if necessary. If its content exceeds 8 parts by weight, the molecular weight becomes very small and hot offset occurs during printing.

The above-described pigments include inorganic pigments such as metallic-powder-type pigments, and metal-oxide-type, carbon-type, sulfide-type, chromate-type, ferrocyanide-type pigments; and organic pigments such as azo-type, acidic-pigment-type, basic-pigment-type, mordant-pigment-type, phthalocyanine, quinacridone-type, and dioxane-type pigments, which may be used singly or combined with one or more kinds of such compounds. It is preferable to use 1 to 20 parts by weight of the above-described pigment with respect to the total weight of the monomer mixture. If the content of the pigment is less than 1 part by weight, it is not possible to implement the desired color sufficiently; if it exceeds 20 parts by weight, it is difficult for the monomer and pigment to be diffused.

The above-described charge control agents include cationic charge control agents such as nigrosine-type electron acceptor pigments, highly aliphatic metallic salts, alkoxy amines, chelates, quarternary ammonium salts, alkyl amides, fluorinated activating agents, metallic salts of naphthalic acid, etc.; or anionic charge control agents such as electron acceptor organic complexes, fluorinated paraffins, fluorinated polyesters, polyesters containing an excessive amount of acids, sulfonyl amine of copper phthalocyanine, styrene-acryl-group polymers including sulfonic acid radicals, etc., which may be used singly or mixed with one or more kinds of such compounds. It is preferable to use 0.01 to 20 parts by weight of the above-described charge control agent with respect to the total weight of the monomer mixture. If its content is less than 0.01 parts by weight, it is not possible to have a sufficient charge density which is necessary for printing; if it exceeds 20 parts by weight, an unnecessarily high charge density is obtained and the pictorial quality is lowered during printing.

The above-described dispersion agents include inorganic dispersion agents, water-soluble organic polymer dispersion agents, etc. Concrete examples of inorganic dispersion agents include calcium phosphate, magnesium salts, hydrophilic silica, hydrophobic silica, colloidal silica, etc.; of water-soluble organic non-ionic polymer dispersion agents include poly(oxyethylene) alkyl ether, poly(oxyalkylene) alkyl phenol ether, sorbitan fatty acid ester, poly(oxyalkylene) fatty acid ester, glycerine fatty acid ester, poly(vinyl alcohols), alkyl cellulose, poly(vinyl pyrrolidone), etc.; and of water-soluble organic ionic polymer dispersion agents include poly(acryl amides), poly(vinyl amine), poly(vinyl amine) N-oxide, polyvinyl ammonium salts, polydialkyl diallyl ammonium slats, polyacrylic acid, polystyrene sulfonic acid, polyacrylic acid salts, polystyrene sulfonic acid salts, polyaminoalkyl acrylic acid salts, etc. The above-described dispersion agents may be used singly or mixed with one or more kinds of such compounds. It is preferable to use 0.01 to 10 parts by weight of the above-described dispersion agent with respect to the total weight of the aqueous solution. If its content is less than 0.1 parts by weight, the reaction stability is disturbed during suspension polymerization; if it exceeds 10 parts by weight, the formation of unnecessary side-reaction materials (emulsion particles) is increased and the sizes of toner particles may become smaller than those to be implemented.

The above-described anionic surfactants include fatty acid salts, alkyl sulfuric acid ester salts, alkyl allyl sulfuric acid ester salts, dialkyl sulfosuccinates, alkyl phosphates, etc., which may be used singly or mixed with one or more kinds of such compounds. It is preferable to use 0.001 to 20 parts by weight of the above-described anionic surfactant with respect to the total weight of the aqueous solution. If its content is less than 0.001 parts by weight, the reaction stability is disturbed during suspension polymerization; if it exceeds 20 parts by weight, the formation of unnecessary side-reaction materials (emulsion particles) is increased and the sizes of toner particles may become smaller than those to be implemented.

The above-described polar grafting agents include ethylene dimethacrylate, ethylene glycol dimethacrylate, diethylene glycol diacrylate, 1,6-hexamethylene diacrylate, allyl methacrylate, 1,1,1-trimethylol propane triacrylate, triallyl amine, etc., which may be used singly or mixed with one or more kinds of such compounds. It is preferable to use 0.001 to 10 parts by weight of the above-described polar grafting agent with respect to the total weight of monomers. If its content is less than 0.001 parts by weight, it is not possible to form the shell of a hard portion made on the core; if it exceeds 10 parts by weight, the gelation of the core is over-done and settling of the toner is lowered during printing.

The above-described waxes include but are not limited specially to petroleum refined waxes, natural waxes, and synthetic waxes. Concrete examples of petroleum refined waxes include paraffin waxes, microcrystalline waxes, ceresin waxes, of natural waxes include carnauba waxes, etc. and of synthetic waxes include polyethylene, polypropylene, etc., which may be used singly or mixed with one or more kinds of such compounds. It is preferable to use 0.01 to 30 parts by weight of the above-described wax with respect to the total weight of monomers. If its content is less than 0.01 parts by weight, settling during printing and spreading of the wax on the surface of the toner are lowered; and if it exceeds 30 parts by weight, the reaction stability is lowered.

BRIEF DESCRIPTION OF THE DRAWINGS

The foregoing and other objects, aspects, and advantages will be better understood from the following detailed description of preferred embodiments of the invention with reference to the drawings, in which.

BEST MODE FOR CARRYING OUT THE INVENTION

Figure 1:
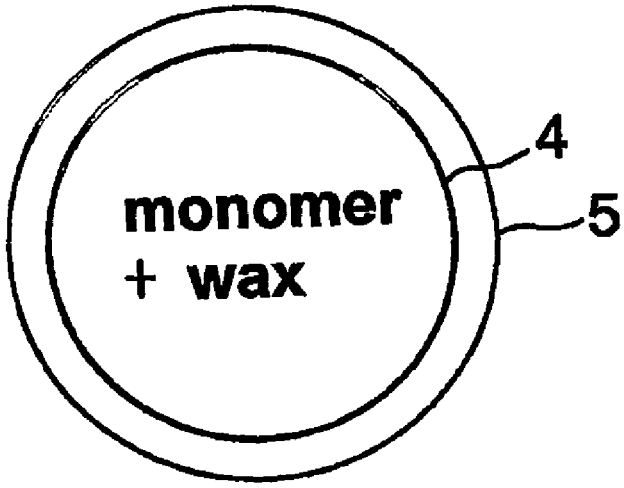
FIG. 1 is an approximate diagram showing toner particles having a double-layered structure according to the present invention.

The present invention is illustrated in more detail through the following preferred embodiments:

Preferred Embodiment 1

Manufacture of the Single-layered Toner Using Hydrophilic Monomers and Polar Grafting Agents (1) Step of Manufacture of the Core of a Toner 10 g portion of polyvinyl alcohol and 1 g of dodecyl benzene sulfuric acid ester sodium salt were put into a 500-ml volumetric flask and melted with 400 g of distilled water in order to prepare for an aqueous solution, and heated to 70° C. which was a reaction temperature.

Also, 160 g of styrene, 36 g of butyl acrylate, 4 g of acrylic acid, 4 g of allyl methacrylate, 0.02 g of n-dodecyl mercaptane, and 10 g of cyan pigment were put into another container, and mixed at a speed of 2,000 rpm for 2 hours with a bead mill, after which 105 g of the monomer mixture was prepared for by removing the beads. The mixture thus prepared for was put into another container, and mixed at a speed of 2,000 rpm for 2 hours with a bead mill, after which 105 g of the monomer mixture was prepared for by removing the beads. The mixture thus prepared for was put into the water of 70° C., heated, mixed with 1 g of a styrene-acryl-group polymer charge control agent containing sulfonic acid radicals and 5 g of a paraffin wax for 20 minutes, and melted sufficiently. To the monomer mixture melted sufficiently, 2 g of azobisisobutyronitrile, which was a polymerization initiator, was put, and mixed for 5 minutes in order to prepare for a reaction material.

The reaction material was put into the aqueous solution prepared for in the above, and the reaction was continued while mixing at a speed of 10,000 rpm with a homogenizer for 20 minutes. After 20 minutes, the core was manufactured by mixing with a general mixer at a speed of 600 rpm for 15 hours.

(2) Post-Processing Step

A toner was manufactured by repeating sufficient washing and filtering of the final toner with water in order to remove the dispersion agent and vacuum drying.

Preferred Embodiment 2

Manufacture of a Double-layered Toner Using Hydrophilic Monomers and Polar Grafting agents (1) Step of Manufacture of the Core of a Toner 10 g portion of polyvinyl alcohol and 1 g of dodecyl benzene sulfuric acid ester sodium salt were put into a 500-ml volumetric flask and melted with 400 g of distilled water in order to prepare for an aqueous solution, and heated to 70° C. which was a reaction temperature.

Also, 160 g of styrene, 36 g of butyl acrylate, 4 g of acrylic acid, 4 g of allyl methacrylate, 0.02 g of n-dodecyl mercaptane, and 10 g of cyan pigment were put into another container, and mixed at a speed of 2,000 rpm for 2 hours with a bead mill, after which 105 g of the monomer mixture was prepared for by removing the beads. The mixture thus prepared for was put into the water of 70° C., heated, mixed with 1 g of a styrene-acryl-group polymer charge control agent containing sulfonic acid radicals and 5 g of a paraffin wax for 20 minutes, and melted sufficiently. To the monomer mixture melted sufficiently, 2 g of azobisisobutyronitrile, which was a polymerization initiator, was put, and mixed for 5 minutes in order to prepare for a reaction material.

The reaction material was put into the aqueous solution prepared for in the above, and the reaction was continued while mixing at a speed of 10,000 rpm with a homogenizer for 20 minutes. After 20 minutes, the core was manufactured by mixing with a general mixer at a speed of 600 rpm for 15 hours.

(2) Step of the Formation of the Shell of the Toner

The final toner was manufactured by forming a shell by putting and mixing the core manufactured in the above Step (1), 20 g of styrene as a monomer, 0.12 g of divinyl benzene as a cross-linking agent, and 0.4 g of azobisisobutyronitrile as a polymerization initiator into a 500-ml volumetric flask.

(3) Post-processing Step

A toner was manufactured by repeating sufficient washing and filtering of the final toner with water in order to remove the dispersion agents and vacuum drying.

Preferred Embodiment 3

Manufacture of a Double-layered Toner Using Hydrophilic Polymers and Polar Grafting Agents (1) Step of Manufacture of the Core of a Toner 10 g portion of colloidal silica was dispersed with 400 g of distilled water in a 500-ml volumetric flask in order to prepare for an aqueous solution, and heated to 70° C. which was a reaction temperature.

Also, 160 g of styrene, 36 g of butyl acrylate, 4 g of allyl methacrylate, 0.02 g of n-dodecyl mercaptane, 8 g of polyester, and 10 g of cyan pigment were put into another container, and mixed at a speed of 2,000 rpm for 2 hours with a bead mill, after which 105 g of the monomer mixture was prepared for by removing the beads. The mixture thus prepared for was put into the water of 70° C., heated, mixed with 1 g of a styrene-acryl-group polymer charge control agent containing sulfonic acid radicals and 5 g of a paraffin wax for 20 minutes, and melted sufficiently. To the monomer mixture melted sufficiently, 2 g of azobisisobutyronitrile, which was a polymerization initiator, was put, and mixed for 5 minutes in order to prepare for a reaction material.

The reaction material was put into the aqueous solution prepared for in the above, and the reaction was continued while mixing at a speed of 10,000 rpm with a homogenizer for 20 minutes. After 20 minutes, the core was manufactured by mixing with a general mixer at a speed of 600 rpm for 15 hours.

(2) Post-processing Step

A toner was manufactured by repeating sufficient washing and filtering of the final toner with water in order to remove the dispersion agents and vacuum drying.

Preferred Embodiment 4

Manufacture of a Triple-layered Toner Using Polar Grafting Agents and Hydrophilic Polymers (1) Step of Manufacture of the Core of a Toner 10 g portion of colloidal silica was dispersed with 400 g of distilled water in a 500-ml volumetric flask in order to prepare for an aqueous solution, and heated to 70° C. which was a reaction temperature.

Also, 160 g of styrene, 36 g of butyl acrylate, 4 g of allyl methacrylate, 0.02 g of n-dodecyl mercaptane, 8 g of polyester, and 10 g of cyan pigment were put into another container, and mixed at a speed of 2,000 rpm for 2 hours with a bead mill, after which 105 g of the monomer mixture was prepared for by removing the beads. The mixture thus prepared for was put into the water of 70° C., heated, mixed with 1 g of a styrene-acryl-group polymer charge control agent containing sulfonic acid radicals and 5 g of a paraffin wax for 20 minutes, and melted sufficiently. To the monomer mixture melted sufficiently, 2 g of azobisisobutyronitrile, which was a polymerization initiator, was put, and mixed for 5 minutes in order to prepare for a reaction material.

The reaction material was put into the aqueous solution prepared for in the above, and the reaction is continued while mixing at a speed of 10,000 rpm with a homogenizer for 20 minutes. After 20 minutes, the core is manufactured by mixing with a general mixer at a speed of 600 rpm for 15 hours.

(2) Step of the Formation of the Shell of the Toner

The final toner was manufactured by forming a shell by putting and mixing the core manufactured in the above Step (1), 20 g of styrene as a monomer, 0.12 g of divinyl benzene as a cross-linking agent, and 0.4 g of azobisisobutyronitrile as a polymerization initiator into a 500-ml volumetric flask.

(3) Post-processing Step

A toner was manufactured by repeating sufficient washing and filtering of the final toner with water in order to remove the dispersion agents and vacuum drying.

Comparative Example 1

Manufacture of a Single-layered Toner not Using Hydrophilic Monomers and Hydrophilic Polymers A toner was manufactured in the same method as that in Preferred Embodiment 1 or 3 except that hydrophilic monomers and hydrophilic polymers were not added.

Comparative Example 2

Manufacture of a Double-layered Toner not Using Hydrophilic Monomers and Hydrophilic Polymers A toner was manufactured in the same method as that in Preferred Embodiment 2 or 4 except that hydrophilic monomers and hydrophilic polymers were not added.

Comparative Example 3

Manufacture of a Double-layered Toner not Using Polar Grafting Agents

A toner was manufactured in the same method as that in Preferred Embodiment 2 except that polar grafting agents were not added.

Comparative Example 4

Manufacture of a Triple-layered Toner not Using Polar Grafting Agents

A toner was manufactured in the same method as that in Preferred Embodiment 4 except that polar grafting agents are not added.

Comparative Example 5

Manufacture of a Double-layered Toner not Using Hydrophilic Monomers, Hydrophilic Polymers, and Polar Grafting Agents A toner was manufactured in the same method as that in Preferred Embodiment 2 or 4 except that hydrophilic monomers and hydrophilic polymers were not added.

Testing Example 1

Measurement of the Sizes of Toner Particles

Figure 3:
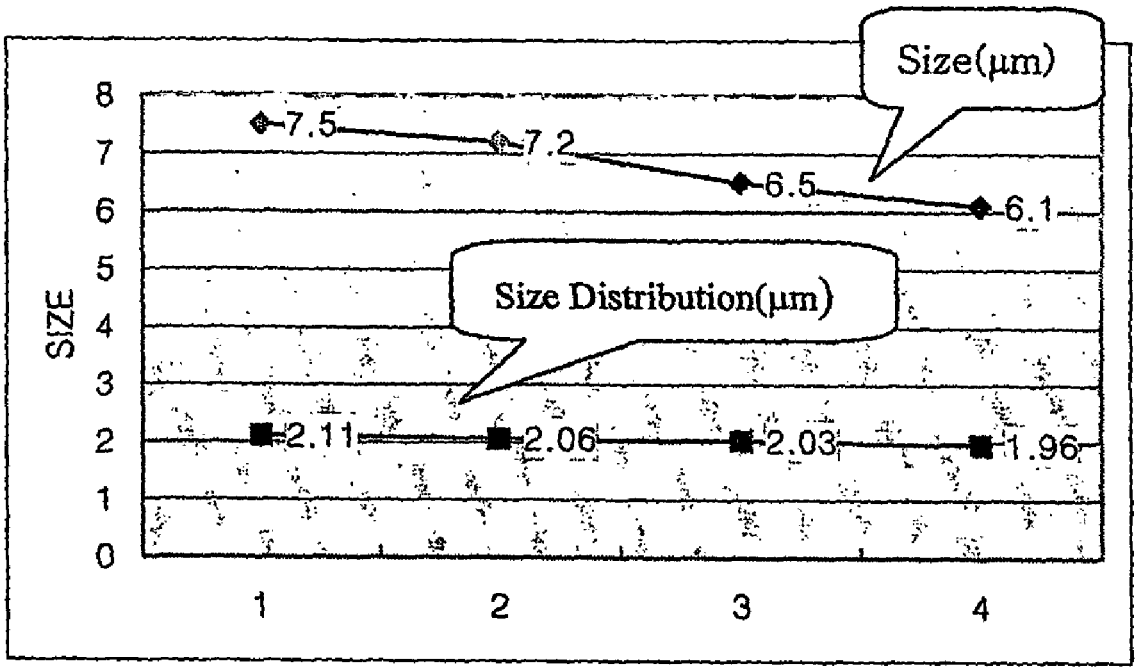
FIG. 3 is a graph showing the result of measurement of the size of toner particles manufactured in Preferred Embodiments 1 to 4 and Comparative Examples 1 and 2 using a multisizer Coulter counter.

The sizes of toner particles manufactured in Preferred Embodiments 1 to 4 and Comparative Examples 1 and 2 were measured by using a multisizer Coulter counter, of which results were shown in FIG. 3.

As seen in the graph of FIG. 3, if hydrophilic monomers of Preferred Embodiment 1 were added, toner particles generally have a size of about 6.1 micrometers, which was the same as that of the case in which no hydrophilic monomers in Comparative Example 1 were added. It was because, in case of hydrophilic monomers, co-polymers were formed randomly with other monomers at the outer side of particles during polymerization, and thus, the particle sizes were not affected greatly. Here, it was seen that the sizes were increased to 6.1 to 7.2 micrometers (??) if a shell was made in the rigid layer, which implies that the double-layered structure was formed successfully.

It was also seen that, if hydrophilic polymers were added, the sizes of toner particles were increased to 6.1 to 6.5 micrometers compared to the case that hydrophilic monomers were used. It was because hydrophilic polymers form thin layers at the outer side of particles after polymerization. Further, if a shell of the hard portion was made once again to improve weatherability, the sizes were increased to 6.5 to 7.5 micrometers, which implied that another layer was formed over the hydrophilic polymers.

Testing Example 2

Measurement of the Shapes of Toner Particles

The shapes of toner particles manufactured in Preferred Embodiments 2 to 4 and Comparative Examples 3 to 5 were measured by using a scanning electron microscope (SEM). The results of measurement were shown in FIG. 4.

Figure 4:
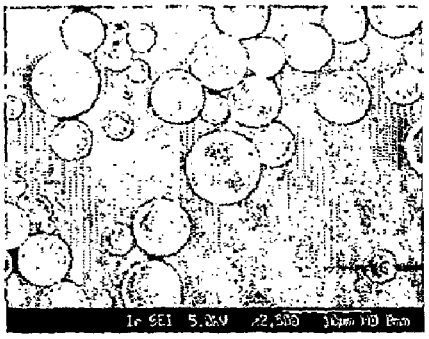
FIG. 4 is a photograph showing the result of measurement of the shape of toner particles manufactured in Preferred Embodiments 2 to 4 and Comparative Examples 3 to 5.
Figure 4:
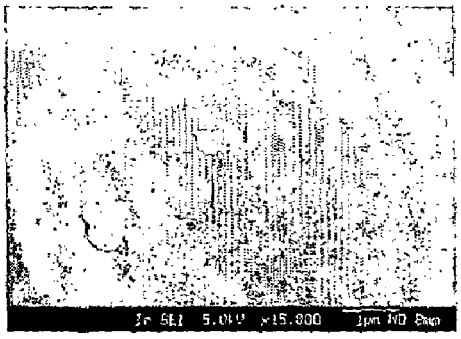
Figure 4:
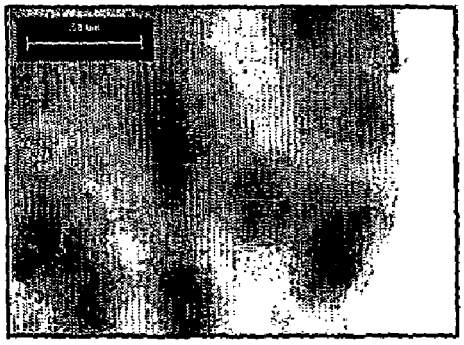

As seen in the SEM photograph of FIG. 4(*a*), in cases of Preferred Embodiments 2 to 4 in which a shell in the hard portion was made by using polar grafting agents, toner particles were spherical particles having the surface with almost no curves. This was the same in Preferred Embodiment 1 and Comparative Examples 1 and 2. However, it was difficult to find out whether the layers were formed from SEM, and whether the layers were formed may be known indirectly through the difference in sizes mentioned in the above.

According to the SEM photograph of FIG. 4(*b*), in case of Preferred Embodiment 3 in which hydrophilic polymers were added, the surface of particles was shown to be curved contrary to the previous case. Here, it was seen indirectly that hydrophilic polymers form new layers at the outer side of the toner.

As seen in the SEM photograph of FIG. 4(*c*), if a shell of the hard layer was made without adding polar grafting agents, light and darkness were shown as seen in the photograph. Here, the black portion was a domain created when the styrene-group monomer inputted in order to form the shell fail to form the layer efficiently but was diffused into the relatively non-polar core.

Figure 2:
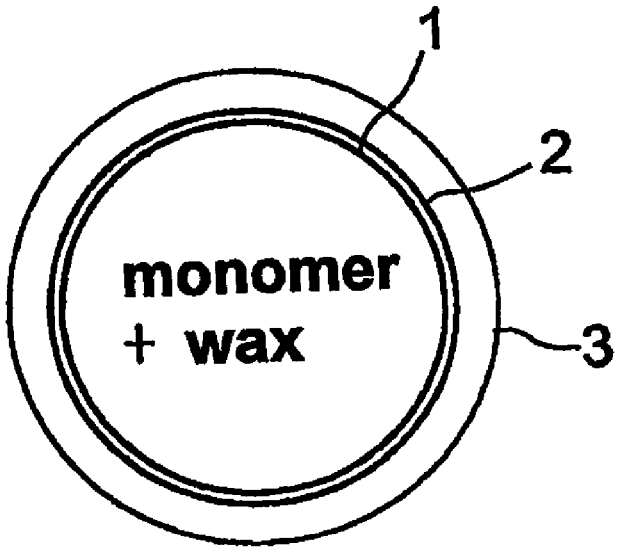
FIG. 2 is an approximate diagram showing toner particles having a triple-layered structure according to the present invention.

The approximate double-layered structure of the toner according to Preferred Embodiment 2 was as shown in FIG. 1, where the first layer (4) of toner particles was a soft layer, over which surface the pigment and charge control agent were gathered; and the second layer (5) was a rigid layer, over which a thin shell was formed. And an approximate triple-layered structure of the toner according to Preferred Embodiment 4 was as shown in FIG. 2, where the second layer (2) was a polar polymer layer, over which the pigment and charge control agent were gathered; and the second layer (3) was a rigid layer over which a thin shell is formed.

Testing Example 3

Measurement of the Amount of Charging and Image Concentration

The toners manufactured in Preferred Embodiments 1 through 4 and Comparative Examples 1 through 5 were mixed with 2 parts by weight of surface-processed silica RY200S, and stirred in a blender at a speed of 3,000 rpm for 3 minutes in order to process the surface. Their amounts of charging were measured in the suction method in an HP4500 printer, of which results were shown in Table 1 below; and the image concentrations of sheets of paper printed were measured, of which results were also shown in Table 1 below:

TABLE 1

| Sample number | Amount of charging (μC/g) | Image concentration |
|---|---|---|
| Preferred Embodiment 1 | −50 | 1.5 |
| Preferred Embodiment 2 | −46 | 1.5 |
| Preferred Embodiment 3 | −54 | 1.5 |
| Preferred Embodiment 4 | −49 | 1.5 |
| Comparative Example 1 | −21 | 1.3 |
| Comparative Example 2 | −19 | 1.3 |
| Comparative Example 3 | −48 | 1.4 |
| Comparative Example 4 | −44 | 1.4 |
| Comparative Example 5 | −19 | 1.3 |

As shown in the above Table 1, in view of Preferred Embodiments 1 and 2 of the present invention, the affect of the formation of a hard shell at the outer side of particles on the amount of charging of the toners is very insignificant. However, it is seen that Comparative Example 1, in which no hydrophilic monomers or hydrophilic polymers are put into, has low amount of charging and image concentration values compared to Preferred Embodiments 1 to 3, in which hydrophilic monomers and hydrophilic polymers are put into. It is seen from the above results that the addition of hydrophilic monomers and hydrophilic polymers has a great affect on the amount of charging and color concentration of the toners, but the rigid layered structure at the outermost side is not greatly related to the amount of charging and color concentration of the toners.

Testing Example 4

Measurement of Waterproofing and Weatherability of Toners

In order to study how affective the shell portion forming the outermost side of the toner is on moisture and temperature, thermohydrostatic experiments were performed. In the pyrohumid test (30° C./RH 80%), cartridges were put into a thermohydrostat and left for about 10 hours to allow saturation. Thereafter, a printer was put into a thermohydrostat in order to perform the 100-sheet short-term test, and waste, Q/M, and printing efficiency were measured. All of PCR was cleaned before and after the pyrohumid evaluation.

TABLE 2

| | Amount of consumption (g) | Rate of printing (%) |
|---|---|---|
| Preferred Embodiment 1 | 4.2 | 73 |
| Preferred Embodiment 2 | 2.1 | 94 |
| Preferred Embodiment 3 | 4.5 | 70 |
| Preferred Embodiment 4 | 2.4 | 91 |
| Comparative Example 1 | 3.6 | 82 |
| Comparative Example 2 | 2.4 | 91 |
| Comparative Example 3 | 4.0 | 76 |
| Comparative Example 4 | 4.1 | 75 |
| Comparative Example 5 | 4.7 | 69 |

As shown in the above Table 2, it is seen that, in Preferred Embodiments 1 and 3 having no rigid-shell structure, compared to Preferred Embodiments 2 and 4 having a rigid-shell structure, the toner is not printed to sheets of paper during printing, the amount of waste remained in cartridges is very large, and the printing rate is lowered greatly. In other words, it is seen that the toner is less sensitive to moisture and temperature as there exists the non-polar shell layer. It is also seen that, in Preferred Embodiments 1 to 3 having hydrophilic monomers or polymers, compared to Comparative Example 1 having no hydrophilic monomers or polymers relatively, the amount of waste and printing rate are lowered. It seems to be that the toner becomes more sensitive to moisture as hydrophilic monomers or hydrophilic polymers are put into the toner. Therefore, in order to manufacture a weatherproof toner that is tolerant to moisture or temperature change, the outermost side of the toner should be equipped with a rigid-shell structure.

As illustrated in the above, the present invention is a useful invention in that it provides with toners that can prevent entangling due to moisture as the double or triple layers are included and improve weatherability.

While certain present preferred embodiments of the invention have been shown and described, it is to be distinctly understood that the invention is not limited thereto but may be otherwise variously embodied and practiced within the scope of the following claims:

What is claimed is:

1. A toner having a single-layered structure said toner being manufactured through the suspension polymerization of binder resin monomers, molecular weight controlling agents, pigments, charge control agents, dispersion agents, anionic surfactants, waxes, polar grafting agents, and hydrophilic monomers, wherein the toner is comprised of toner particles with pigments and charge control agents on the surface of said toner particles.

2. A toner having a double-layered structure said toner being manufactured through the suspension polymerization of binder resin monomers, molecular weight controlling agents, pigments, charge control agents, dispersion agents, anionic surfactants, waxes, polar grafting agents, and hydrophilic polymers, wherein the toner is comprised of toner particles with pigments and charge control agents on the surface of said toner particles.

3. A toner having a double-layered structure said toner being manufactured by forming a single-layered structure through the suspension polymerization of binder resin monomers, molecular weight controlling agents, pigments, charge control agents, dispersion agents, anionic surfactants, waxes, polar grafting agents, and hydrophilic monomers, so that the toner is comprised of toner particles with pigments and charge control agents on the surface of said toner particles; and further manufacturing a shell, which is a rigid layer, by inputting a styrene-group monomer and a cross-linking agent over said single-layered structure.

4. A toner having a triple-layered structure said toner being manufactured by forming a double-layered structure through the suspension polymerization of binder resin monomers, molecular weight controlling agents, pigments, charge control agents, dispersion agents, anionic surfactants, waxes, polar grafting agents, and hydrophilic polymers, so that the toner is comprised of toner particles with pigments and charge control agents on the surface of said toner particles; and further manufacturing a shell, which is a rigid layer, by inputting a styrene-group monomer and a cross-linking agent over said single-layered structure.

5. The toner according to claim 1 or 3, wherein said hydrophilic monomers are one or more kinds of compounds selected from the group consisting of acrylic acid, methyl methacrylate, and acetate; and the content of said hydrophilic monomer is 0.1 to 20 parts by weight with respect to the total weight of the monomer mixture.

6. The toner according to claim 2 or 4, wherein said hydrophilic polymers are one or more kinds of polar polymers selected from the group consisting of polyester-group and styrene-acryl-group polymers; and the content of said hydrophilic polymers is 0.1 to 20 parts by weight with respect to the total weight of the monomer mixture.

7. The toner according to any of claims 1 through 4, wherein said polar grafting agents are one or more kinds of compounds selected from the group consisting of ethylene dimethacrylate, ethylene glycol dimethacrylate, diethylene glycol diacrylate, 1,6-hexamethylene diacrylate, allyl methacrylate, 1,1,1-trimethylol propane triacrylate, and triallyl amine; and the content of said polar grafting agents is 0.001 to 10 parts by weight with respect to the total weight of the monomer mixture.

8. The toner according to any of claims 1 through 4, wherein said binder resin monomers are one or more kinds of compounds selected from the group consisting of aromatic-vinyl-group, acrylate-group, methacrylate-group, diene-group, acidic-olefin-group, and basic-olefin-group monomers; and the content of said binder resin monomers is 0.1 to 20 parts by weight with respect to the total weight of the monomer mixture.

9. The toner according to any of claims 1 through 4, wherein:

said pigments are one or more kinds of inorganic pigments selected from the group consisting of metallic-powder-type, metal-oxide-type, carbon-type, sulfide-type, chrome-salt-type, and ferrocyanide-type pigments; or one or more kinds of organic pigments selected from the group consisting of azo-type, acidic-pigment-type, basic-pigment-type, mordant-pigment-type, phthalocyaniquinacridone-type, and dioxane-type pigments; and the content of said pigments is 1 to 20 parts by weight with respect to the total weight of the monomer mixture.

10. The toner according to any of claims 1 through 4, wherein:

said charge control agents are one or more kinds of cationic charge control agents selected from the group consisting of nigrosine-type electron acceptor pigments, highly aliphatic metallic salts, alkoxy amines, chelates, quarternary ammonium salts, alkyl amides, fluorinated activation agents, and metallic salts of naphthalic acid; or one or more kinds of anionic charge control agents selected from the group consisting of electron acceptor organic complexes, chlorinated paraffins, chlorinated polyesters, polyesters containing an excessive amount of acids, sulfonyl amine of copper phthalocyanine, and styrene-acryl-group polymers including sulfonic acid radicals; and the content of said charge control agents is 0.01 to 20 parts by weight with respect to the total weight of the monomer mixture.

11. The toner according to any of claims 1 through 4, wherein:

said dispersion agents are one or more kinds of inorganic dispersion agents selected from the group consisted of calcium phosphates, magnesium salts, hydrophilic silica, hydrophobic silica, and colloidal silica; or one or more kinds of water-soluble organic polymer dispersion agents selected from the group consisting of one or more kinds of non-ionic polymer dispersion agents selected from the group consisting of poly (oxyethylene) alkyl ethers, poly(oxyalkylene) alkyl phenol ethers, sorbitan fatty acid esters, poly(oxyalkylene) fatty acid esters, glycerine fatty acid esters, poly (vinyl alcohols), alkyl cellulose, and poly(vinyl pyrrolidone); and one or more kinds of ionic polymer dispersion agents selected from the group consisting of poly(acryl amides), poly(vinyl amine), poly(vinyl amine) N-oxide, polyvinyl ammonium salt, polydialkyldiallyl ammonium slats, polyacrylic acid, polystyrene sulfonic acid, polyacrylic acid salt, polystyrene sulfonic acid salt, and polyaminoalkyl acrylic acid salts; and the content of said dispersion agents is 0.01 to 10 parts by weight with respect to the total weight of the monomer mixture.

12. The toner according to any of claims 1 through 4, wherein said anionic surfactants are one or more kinds of compounds selected from the group consisting of fatty acid salts, alkyl sulfuric acid ester salts, alkylallyl sulfuric acid ester salts, dialkyl sulfosuccinates, and alkyl phosphates; and the content of said anionic surfactants is 0.001 to 20 parts by weight with respect to the total weight of the aqueous solution.

13. The toner according to any of claims 1 through 4, wherein:

said waxes are one or more kinds of petroleum refined waxes selected from the group consisting of paraffin waxes, microcrystalline waxes, and ceresin wax;

natural wax which is the camauba wax; or one or more kinds of synthetic waxes selected from the group consisting of polyethylene and polypropylene; and the content of said waxes is 0.01 to 30 parts by weight with respect to the total weight of the monomer mixture.

14. The toner according to any of claims 1 through 4, wherein said molecular weight controlling agents are one or more kinds of mercaptane-group compounds selected from the group consisting of t-dodecyl mercaptane and n-dodecyl mercaptane; and the content of said molecular weight controlling agents is 0.1 to 8 parts by weight with respect to the total weight of the monomer mixture.

15. The toner according to claim 3 or 4, wherein the content of said styrene-group monomer and the content of said cross-linking agent are 1 to 30 parts by weight and 0 to 5 parts by weight, respectively.

* * * * *